US008055150B2

(12) United States Patent
Kim et al.

(10) Patent No.: US 8,055,150 B2
(45) Date of Patent: Nov. 8, 2011

(54) IMAGE FORMING APPARATUS AND FRAME UNIT THEREOF INCLUDING A PARTICLE MANAGEMENT DEVICE

(75) Inventors: Jong In Kim, Suwon-si (KR); Myoung Su Baek, Suwon si (KR); Sung Gi Kim, Seoul (KR); Ho jin Jang, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 470 days.

(21) Appl. No.: 12/206,003

(22) Filed: Sep. 8, 2008

(65) Prior Publication Data

US 2009/0214251 A1 Aug. 27, 2009

(30) Foreign Application Priority Data

Feb. 21, 2008 (KR) ..... 10-2008-0015800
Mar. 31, 2008 (KR) ..... 10-2008-0029608

(51) Int. Cl.
*G03G 21/00* (2006.01)

(52) U.S. Cl. ..... 399/98

(58) Field of Classification Search ..... 399/98, 399/99, 107, 341

See application file for complete search history.

(56) References Cited

U.S. PATENT DOCUMENTS

| | | | | |
|---|---|---|---|---|
| 4,501,484 | A | 2/1985 | Shimura | |
| 2005/0196204 | A1 * | 9/2005 | Funato et al. | 399/341 |
| 2007/0116491 | A1 | 5/2007 | Park et al. | |

FOREIGN PATENT DOCUMENTS

| | | | |
|---|---|---|---|
| CN | 1983058 | | 6/2007 |
| EP | 0461759 | | 12/1991 |
| JP | 5100606 | | 4/1993 |
| JP | 2000305341 | A * | 11/2000 |
| JP | 2006106589 | | 4/2006 |

OTHER PUBLICATIONS

Chinese Office Action issued Oct. 11, 2010 in CN Application No. 200810168037.X.
European Search Report issued Sep. 24, 2009 in EP Application No. 08168523.2.

* cited by examiner

*Primary Examiner* — Quana M Grainger
(74) *Attorney, Agent, or Firm* — Stanzione & Kim, LLP

(57) ABSTRACT

An image forming apparatus includes an image carrier, an exposure unit to form a latent image on the image carrier by light, and a particle entering prevention device to prevent particles from entering an optical path between the exposure unit and the image carrier. The particle entering prevention device includes a particle storage unit disposed in a vicinity of the optical path, to store the particles therein.

22 Claims, 6 Drawing Sheets

IMAGE FORMING APPARATUS AND FRAME UNIT THEREOF INCLUDING A PARTICLE MANAGEMENT DEVICE

CROSS-REFERENCE TO RELATED APPLICATIONS

This application claims priority under 35 U.S.C. §119(a) from Korean Patent Application Nos. 2008-0015800 and 2008-0029608, filed on Feb. 21 and Mar. 31, 2008 in the Korean Intellectual Property Office, the disclosures of which are incorporated herein in their entirety by reference.

BACKGROUND OF THE INVENTION

1. Field of the Invention

The present general inventive concept relates to an image forming apparatus, and, more particularly, to an image forming apparatus, which can prevent contamination of an optical path between an exposure unit and an image carrier.

2. Description of the Related Art

Image forming apparatuses are devised to form an image on a printing medium according to an input image signal. Examples of image forming apparatuses include printers, copiers, facsimiles, and devices combining functions thereof Of a variety of image forming apparatuses, an electrophotographic image forming apparatus includes a photosensitive member, an exposure unit, and a developing unit. The exposure unit scans light to the photosensitive member, which was charged with a predetermined electric potential, to form an electrostatic latent image on a surface of the photosensitive member. The developing unit supplies developer to the photosensitive member on which the electrostatic latent image is formed, to form a visible image.

The visible image, formed on the photosensitive member, is transferred to a printing medium transported from a printing medium feeding unit. The printing medium, to which the image is transferred, is discharged outside of the image forming apparatus after undergoing a fixing operation to fix the transferred image to the printing medium.

Generally, the exposure unit includes a housing having a light-transmission part, and a scanning optical system mounted in the housing. Light generated from the scanning optical system is emitted outside of the housing through the light-transmission portion. The emitted light is irradiated to the surface of the photosensitive member by passing through an optical path between the exposure unit and the photosensitive member, thereby forming the electrostatic latent image on the surface of the photosensitive member.

The image forming apparatus contains a variety of particles, including developer scattered from the photosensitive member and the developing unit, paper dust scattered from the printing medium, or dirt introduced from the outside. If the particles enter the optical path between the exposure unit and the photosensitive member, the particles prevent the light from being scanned to the photosensitive member, causing failure in the formation of the electrostatic latent image or deterioration of image quality.

SUMMARY OF THE INVENTION

The present general inventive concept provides an image forming apparatus to prevent particles from entering an optical path between an exposure unit and a photosensitive member, and a frame unit of the image forming apparatus.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including an image carrier, an exposure unit to form a latent image on the image carrier by light, and a particle entering prevention device to prevent particles from entering an optical path between the exposure unit and the image carrier, wherein the particle entering prevention device includes a particle storage unit disposed in a vicinity of the optical path, to store the particles therein.

The image forming apparatus may further include a frame unit having a light window disposed on the optical path, and the particle storage unit may be provided in a vicinity of the light window.

The particle storage unit may include a particle storage recess formed at the frame unit.

The particle storage unit may have a larger width than a scanning width of light passing through the light window.

The particle entering prevention device may further include a particle shield wall disposed between the particle storage unit and the optical path.

The image forming apparatus may further include at least one rotator disposed around the rotating image carrier, and the particle storage unit may be disposed below the rotator.

The particle entering prevention device may further include a side member serving not only to rotatably support the rotator, but also to block a side of the optical path.

The particle entering prevention device may further include a protruding wall configured to protrude toward the image carrier in a vicinity of the optical path.

The particle entering prevention device may further include a film member having one side fixed to the protruding wall and the other side in contact with the image carrier.

The particle entering prevention device may further include sealing members to seal both ends of the image carrier.

The frame unit may include a main frame, and a frame cover to cover the main frame, the light window may include a first light-transmission hole formed at the main frame, and a second light-transmission hole formed at the cover to correspond to the first light-transmission hole, and the particle storage recess may be formed in a vicinity of the second light-transmission hole.

The frame unit may store waste developer therein, and the particle entering prevention device may further include a sidewall protruding upward from a rim of the first light-transmission hole, to prevent the waste developer from entering the light window.

The exposure unit may include a light-transmission member disposed on the optical path, and the light-transmission member and the light window may be not vertically aligned.

The foregoing and/or other aspects and utilities of the general inventive concept may also be achieved by providing an image forming apparatus including an image carrier, an exposure unit to form a latent image on the image carrier by light, and a particle storage unit disposed in a vicinity of an optical path between the exposure unit and the image carrier, to prevent particles from entering the optical path, wherein the particle storage unit has a larger width than a scanning width of light passing through the particle storage unit.

The foregoing and/or other aspects and utilities of the general inventive concept may also be achieved by providing an image forming apparatus including a photosensitive member, an exposure unit to form a latent image on the photosensitive member by light, a frame unit having a light window disposed on an optical path between the exposure unit and the photosensitive member, and a particle storage unit to store particles in a vicinity of the light window, so as to prevent the particles from entering the light window.

The foregoing and/or other aspects and utilities of the general inventive concept may also be achieved by providing a frame unit usable with an image forming apparatus, the frame unit including a light window through which light scanned from an exposure unit of the image forming apparatus passes, and a particle entering prevention device to prevent particles from entering the light window, and the particle entering prevention device may include a particle storage unit disposed in the vicinity of the light window.

The frame unit may further include a main frame, and a frame cover to cover the main frame, and the light window may include a first light-transmission hole formed at the main frame, and a second light-transmission hole formed at the frame cover to correspond to the first light-transmission hole.

The particle storage unit may include a particle storage recess formed at one side of the second light-transmission hole.

The particle storage recess may have a larger width than a scanning width of light passing through the second light-transmission hole.

The particle entering prevention device may further include a particle shield wall disposed between the particle storage recess and the second light-transmission hole.

The frame unit may further include a photosensitive member on which an electrostatic latent image is formed by light scanned through the light window.

The frame unit may further include a charging roller to charge the photosensitive member, and a cleaning roller to clean the charging roller, and the particle storage unit may be disposed below the cleaning roller.

The foregoing and/or other aspects and utilities of the general inventive concept may also be achieved by providing a particle entering prevention device usable with an image forming apparatus having a frame unit, a photosensitive member, an exposure unit and an optical path between the exposure unit and the photosensitive member, the particle entering prevention device including a plurality of side members attached to opposite ends of the frame unit, a protruding wall disposed between the plurality of side members and to protrude from frame cover toward the photosensitive member, a film member in contact with and to shield a space between the protruding wall and the photosensitive member, and a plurality of sealing members interposed between two sides of the photosensitive member, wherein the particle entering prevention device prevents particles from entering the optical path.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
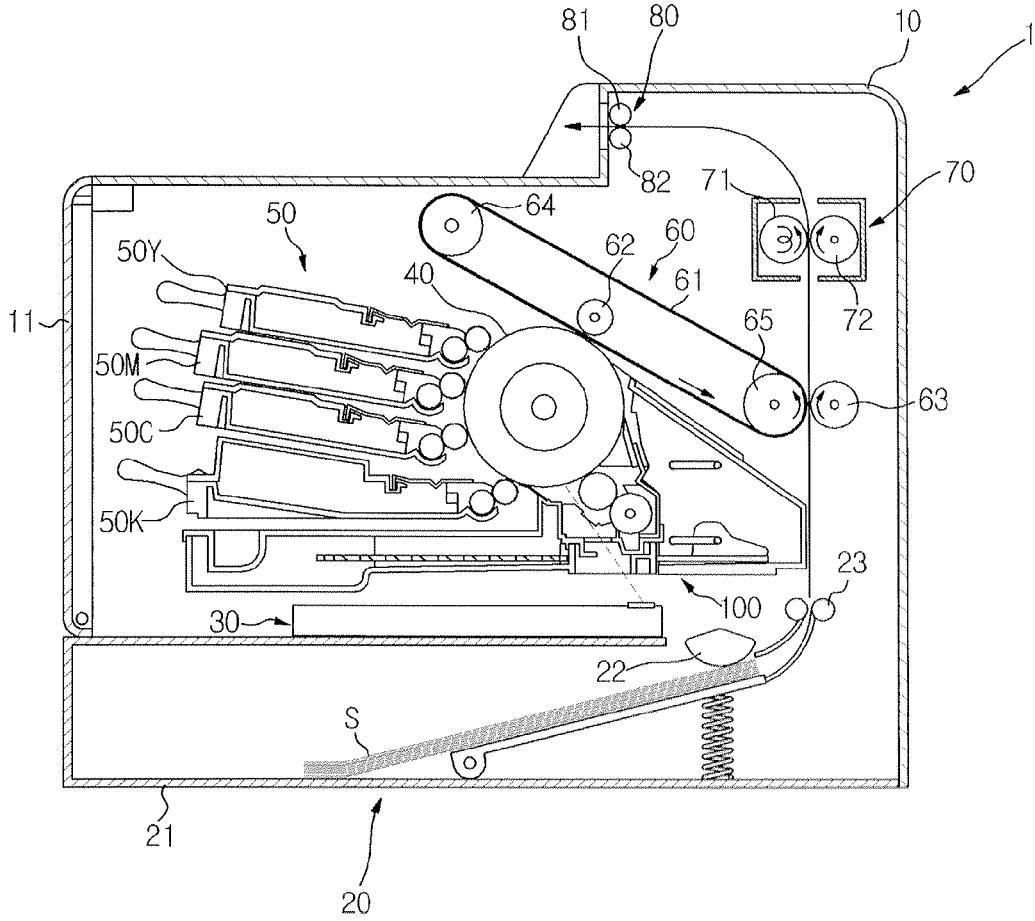
FIG. 1 is a view illustrating a configuration of an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
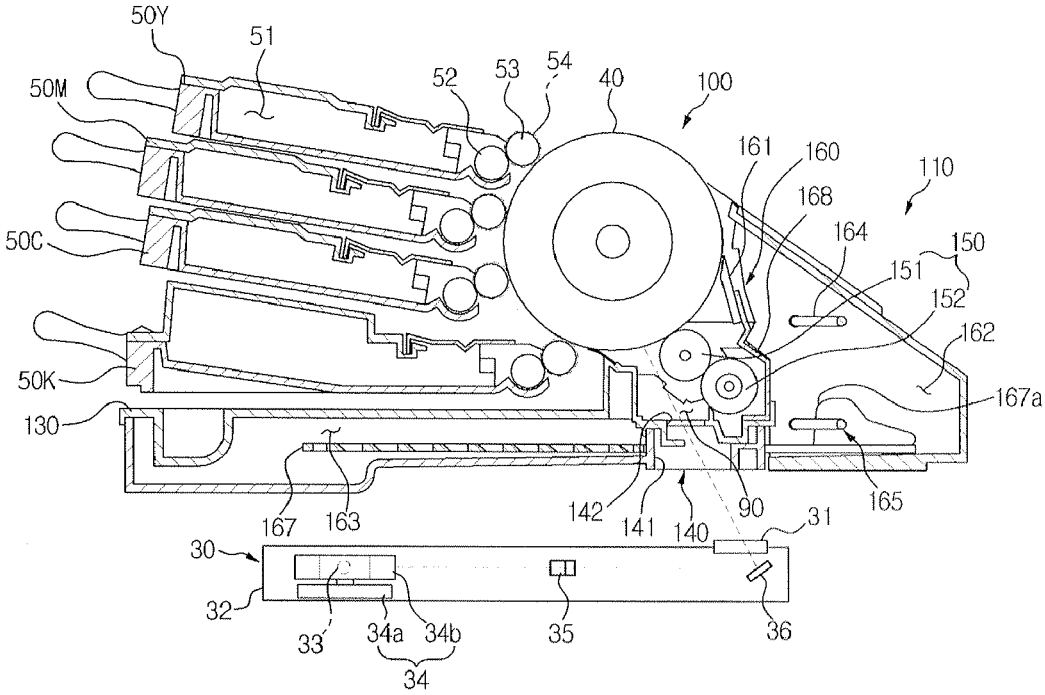
FIG. 2 is a view illustrating some portions of the image forming apparatus of FIG. 1.

FIG. 1 is a view illustrating a configuration of an image forming apparatus in accordance with an embodiment of the present general inventive concept. FIG. 2 is a view illustrating some portions of the image forming apparatus of FIG. 1.

As illustrated in FIGS. 1 and 2, the image forming apparatus 1 includes a body 10, a printing medium feeding unit 20, an exposure unit 30, a photosensitive member 40, a frame unit 100, a developing unit 50, a transfer unit 60, a fixing unit 70, and a printing medium discharge unit 80.

The body 10 defines an external appearance of the image forming apparatus 1, and supports a variety of elements disposed therein. A body cover 11 is pivotally rotatably coupled to one side of the body 10, to open or close a portion of the body 10.

The printing medium feeding unit 20 includes a cassette 21 in which a printing medium S is loaded, a pickup roller 22 to pick up the printing medium S loaded in the cassette 21 sheet by sheet, and a transportation roller 23 to transport the picked-up printing medium S to the transfer unit 60.

The exposure unit 30 is disposed below the frame unit 100, and scans light corresponding to image information to the photosensitive member 40. The exposure unit 30 includes a case 32 provided with a light-transmission member 31 to allow emission of light to the outside, and a scanning optical system mounted in the case 32.

The scanning optical system includes a light source 33 to emit light according to an image signal, a light deflector 34 to deflect the light emitted from the light source 33, an F-theta lens 35 to compensate for an aberration of the light deflected by the light deflector 34, and a reflecting mirror 36 to reflect the light, having passed through the F-theta lens 35, toward the photosensitive member 40.

The light deflector 34 includes a drive motor 34*a*, and a polygonal mirror 34*b* to be rotated by the drive motor 34*a*. The polygonal mirror 34*b* has a plurality of reflective faces at respective sides thereof, and deflects and scans the light from the light source 33.

Specifically, the light emitted from the light source 33 is deflected by the rotating polygonal mirror 34*b*, and, after passing through the F-theta lens 35, is reflected toward the light-transmission member 31 by the reflecting mirror 36. The light reflected by the reflecting mirror 36 is emitted to the outside of the exposure unit 30 through the light-transmission member 31. The light, emitted to the outside of the exposure unit 30, is scanned to the photosensitive member 40 by passing through an optical path 90 between the exposure unit 30 and the photosensitive member 40, thereby forming an electrostatic latent image on a surface of the photosensitive member 40. The light source to form the electrostatic latent image on the surface of the photosensitive member 40 may be an LED type light source. Also, the light deflector 34, F-theta lens 35, reflecting mirror 36, etc. may be omitted according to the overall configuration.

The photosensitive member 40 is an image carrier to hold an electrostatic latent image formed by the exposure unit 30 and a visible image formed by the developing unit 50. Although the photosensitive member 40 can be selected from a drum-type photosensitive member, rotatable endless belt-type photosensitive member, and the like, the present embodiment adopts a drum-type image carrier. The photosensitive member 40 can be rotatably disposed to the frame unit 100. The frame unit 100 can be referred to as a photosensitive member unit since the frame unit 100 receives and supports the photosensitive member 40.

The frame unit 100 is detachably mounted in the body 10. When the frame unit 100 breaks down or a lifespan of the frame unit 100 ends, a user can repair or exchange the frame unit 100 through the body cover 11 opened away from the body 10.

Figure 3:
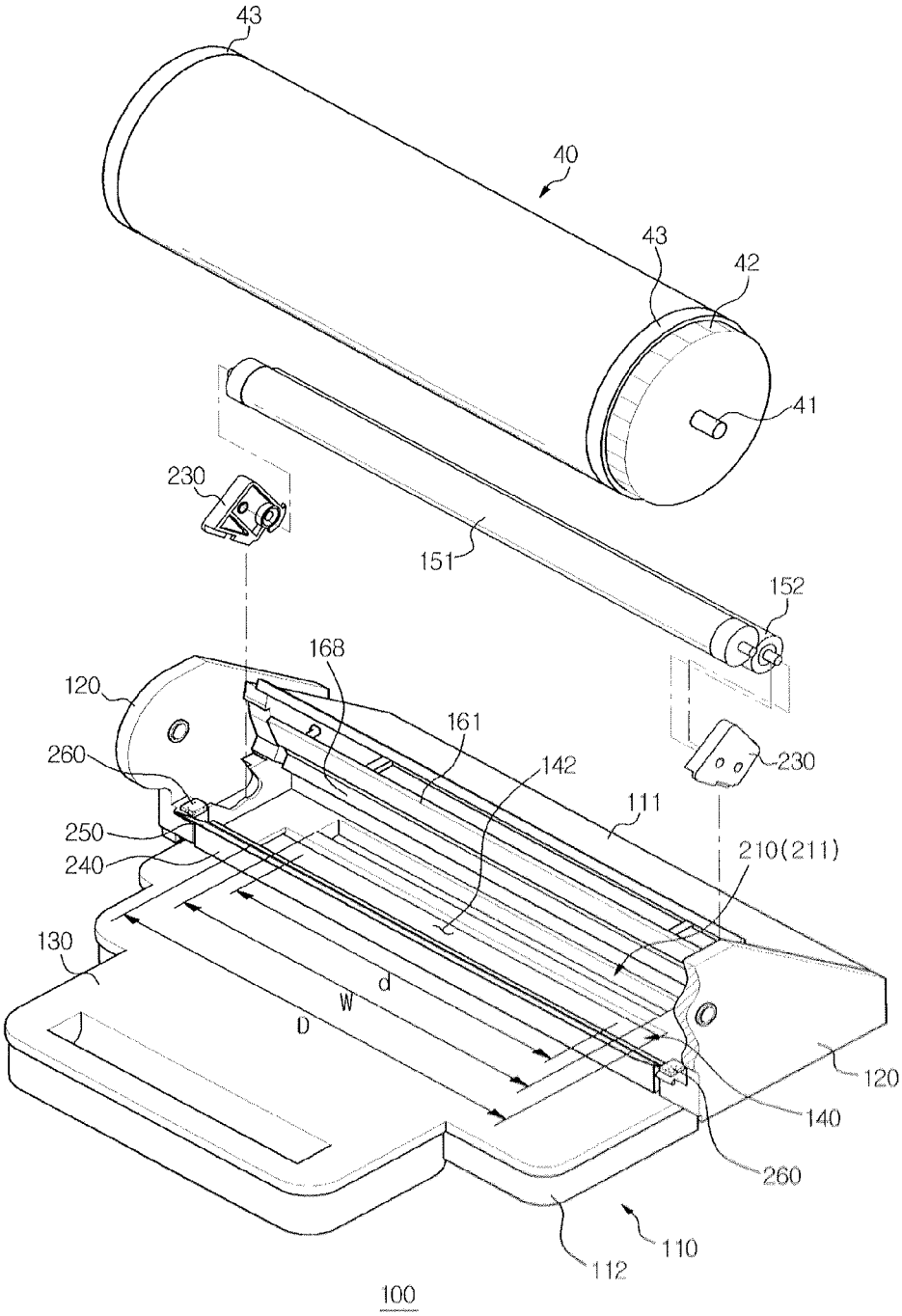
FIG. 3 is a perspective view illustrating a frame unit of the image forming apparatus in accordance with an embodiment of the present general inventive concept.
Figure 4:
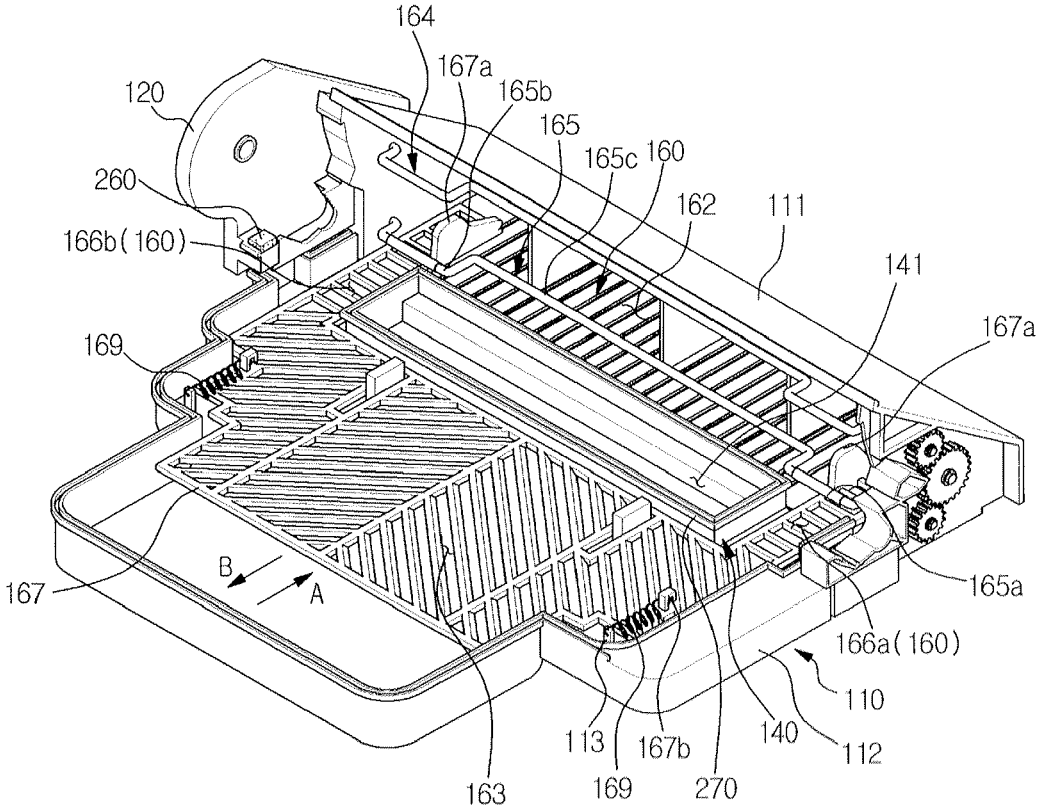
FIG. 4 is a perspective view illustrating an interior configuration of the frame unit of the image forming apparatus in accordance with an embodiment of the present general inventive concept.

FIG. 3 is a perspective view illustrating the frame unit 100 of the image forming apparatus in accordance with the embodiment of the present general inventive concept. FIG. 4 is a perspective view illustrating the interior configuration of the frame unit. In FIG. 4, some portions of the frame unit are omitted from the illustration.

As illustrated in FIGS. 2 to 4, the frame unit 100 includes a main frame 110, which defines an overall external appearance of the frame unit 100 and supports a variety of elements mounted therein, side frames 120 coupled to both lateral sides of the main frame 110, a frame cover 130 to cover the top of the main frame 110, and a light window 140 disposed on the optical path 90 for passage of the light scanned from the exposure unit 30.

A charging roller 151 and a cleaning roller 152 can be mounted in the frame unit 100. The respective rollers 151 and 152 serve as rotators 150 provided to rotate together with the photosensitive member 40. The charging roller 151 charges the photosensitive member 40 with a predetermined electric potential before the exposure unit 30 scans light to the photosensitive member 40. The cleaning roller 152 is rotated in the same direction as or an opposite direction of a rotating direction of the charging roller 151, with a linear velocity difference, in a state of coming into contact with the charging roller 151. The cleaning roller 152 removes particles attached to the charging roller 151.

Referring to FIGS. 2 and 3, a developer collecting device 160 can be mounted in the frame unit 100. The developer collecting device 160 collects and stores waste developer which remains on the surface of the photosensitive member 40 after completing one cycle of developing and transfer operations. In the present embodiment, the developer collecting device 160 is integrated with the frame unit 100. Accordingly, the frame unit 100 can be referred to as a developer storage unit to store the developer.

The developer collecting device 160 includes a cleaning blade 161, a first developer storage section 162, a second developer storage section 163, a rotating member 164, a first developer transportation member 165, a developer movement passages 166*a* and 166*b*, and a second developer transportation member 167.

The main frame 110 includes a first frame portion 111, which protrudes upward to define the first developer storage section 162 therein, and a second frame portion 112, which extends from the first frame portion 111 to define the second developer storage section 163 therein.

The side frames 120 are coupled to both lateral sides of the first frame portion 111, respectively, and in turn, a center shaft 41 of the photosensitive member 40 is rotatably supported by the side frames 120. A photosensitive member gear 42 is disposed to one end of the photosensitive member 40. The photosensitive member gear 42 is engaged with a photosensitive member drive gear (not illustrated) disposed at the body 10 of the image forming apparatus.

Both ends of the photosensitive member 40 come into contact with gap rings 54 (FIG. 2) disposed at the developing unit 50. In FIG. 3, reference numeral 43 represents gap-ring contact portions of the photosensitive member 40 in contact with the gap rings 54 of the developing unit 50.

The first developer storage section 162 has an open portion, and a partition wall 168 is disposed at the open portion. The cleaning blade 161 is disposed to an end of the partition wall 168. The cleaning blade 161 is arranged in such a way that one end thereof comes into contact with the photosensitive member 40 to scrape off residual developer present on the surface of the photosensitive member 40. The developer removed by the cleaning blade 161 is stored in the first developer storage section 162.

The rotating member 164 and the first developer transportation member 165 are arranged at upper and lower positions in the first developer storage section 162. The upper rotating member 164 rotates in the first developer storage section 162, to agitate the developer stored in the first developer storage section 162 to prevent aggregation of the developer. The lower first developer transportation member 165 serves not only to drive the second developer transportation member 167 that will be described hereinafter, but also to agitate the developer stored in the first developer storage section 162.

The first developer transportation member 165 includes first eccentric shaft portions 165*a* and 165*b*, which are eccentrically displaced in a first direction from a rotating center thereof, and a second eccentric shaft portion 165*c* which is eccentrically displaced in a second direction from the rotating center. The first eccentric shaft portions 165*a* and 165*b* are arranged at both lateral side edges of the first developer storage section 162, and the second eccentric shaft portion 165*c* is disposed between the first eccentric shaft portions 165*a* and 165*b*.

The second developer storage section 163 is located in front of the first developer storage section 162 and stores the developer transported from the first developer storage section 162.

The light window 140 is provided between the first developer storage section 162 and the second developer storage section 163. Developer movement passages 166*a* and 166*b* are provided at both lateral sides of the light window 140. The light window 140 allows the light scanned from the exposure unit 30 to reach the photosensitive member 40 by penetrating the frame unit 100. The developer movement passages 166*a* and 166*b* allow the developer stored in the first developer storage section 162 to move into the second developer storage section 163 by detouring the light window 140.

The light window 140 includes a first light-transmission hole 141 perforated in the bottom of the main frame 110, and a second light-transmission hole 142 perforated in the frame cover 130 to correspond to the first light-transmission hole 141. The light emitted from the exposure unit 30 can be scanned to the photosensitive member 40 by sequentially passing through the first light-transmission hole 141 and the second light-transmission hole 142.

The second developer transportation member 167 transports the developer stored in the first developer storage section 162 into the second developer storage section 163. The second developer transportation member 167 transports the developer, transported into the second developer storage section 163, rearward in a "B" direction.

The second developer transportation member 167 has a plate form, and is disposed in the frame unit 100 in a linearly movable fashion.

The second developer transportation member 167 is provided with interference pieces 167*a* at both side ends thereof. The interference pieces 167*a* are located in the first developer storage section 162. The interference pieces 167*a* are arranged to interfere with the first eccentric shaft portions 165*a* and 165*b* of the rotating first developer transportation member 165. If the interference pieces 167*a* interfere with the rotating first eccentric shaft portions 165*a* and 165*b*, the interference pieces 167*a* are pushed by the first eccentric shaft portions 165*a* and 165*b*, causing the second developer transportation member 167 to be moved in an "A" direction.

The second developer transportation member 167 is also provided with first elastic member mounts 167*b* at both side ends thereof. The first elastic member mounts 167*b* are located in the second developer storage section 163. The main frame 110 is provided with second elastic member mounts 113 corresponding to the first elastic member mounts 167*b*.

Each first elastic member mount 167*b* supports one end of an elastic member 169, and the corresponding second elastic member mount 113 supports the other end of the elastic member 169. The elastic member 169 elastically biases the second developer transportation member 167 in an opposite direction ("B" direction) of the "A" direction.

If the first eccentric shaft portions 165*a* and 165*b* are spaced apart from the interference pieces 167*a* of the second developer transportation member 167 according to a rotation of the first developer transportation member 165, the second developer transportation member 167 is moved in the "B" direction by an elastic force of the elastic members 169. In this case, the developer stored in the first developer storage section 162 is transported into the second developer storage section 163 through the developer movement passages 166*a* and 166*b*.

As illustrated in FIGS. 1 and 2, the developing unit 50 supplies developer to the photosensitive member 40 on which the electrostatic latent image is formed. The developing unit 50 may be composed of four developing devices 50Y, 50M, 50C and 50K to receive different colors of developers, for example, Yellow (Y), Magenta (M), Cyan (C) and Black (K), respectively.

Each of the developing devices 50K, 50C, 50M and 50Y includes a developer storage portion 51, a feeding roller 52, and a developing roller 53. The developer storage portion 51 stores the developer to be supplied to the photosensitive member 40, and the feeding roller 52 supplies the developer stored in the developer storage portion 51 to the developing roller 53. The developing roller 53 attaches the developer to the surface of the photosensitive member 40 on which an electrostatic latent image is formed, to form a visible image.

In the present embodiment, the developing unit 50 forms the visible image on the photosensitive member 40 using a non-contact developing method. The developing devices 50Y, 50M, 50C and 50K respective have gap rings 54, which are coaxially disposed to the developing rollers 53 to maintain a predetermined developing gap between the developing roller 53 and the photosensitive member 40. Each developing roller 53 is provided at both sides thereof with the gap rings 54.

The transfer unit 60 includes an intermediate transfer belt 61, a first transfer roller 62, and a second transfer roller 63.

The intermediate transfer belt 61 is supported by supporting rollers 64 and 65 and is adapted to travel at a same speed as a linear velocity of the photosensitive member 40. The first transfer roller 62 is opposite the photosensitive member 40 with the intermediate transfer belt 61 interposed therebetween, to transfer the visible image formed on the photosensitive member 40 to the intermediate transfer belt 61.

The second transfer roller 63 is opposite the supporting roller 65 with the intermediate transfer belt 61 interposed therebetween. The second transfer roller 63 is spaced apart from the intermediate transfer belt 61 while the image is transferred from the photosensitive member 40 to the intermediate transfer belt 61, and then, comes into contact with the intermediate transfer belt 61 at a desired pressure after the image on the photosensitive body 40 is completely transferred to the intermediate transfer belt 61. The image on the intermediate transfer belt 61 is transferred to a printing medium when the second transfer roller 63 comes into contact with the intermediate transfer belt 61.

The fixing unit 70 includes a heating roller 71 having a heating source, and a pressure roller 72 disposed opposite the heating roller 71. When a printing medium passes through a gap between the heating roller 71 and the pressure roller 72, an image is fixed to the printing medium by heat transmitted from the heating roller 71 and pressure exerted between the heating roller 71 and the pressure roller 72.

The printing medium discharge unit 80 includes a printing medium discharge roller 81, and a printing medium backup roller 82, to discharge the printing medium, having passed through the fixing unit 70, to the outside of the body 10.

Now, operation of the image forming apparatus having the above-described configuration will be described. If a printing operation begins, the charging roller 151 uniformly charges the surface of the photosensitive member 40. Then, the exposure unit 30 scans light corresponding to image information of any one color, for example, yellow to the uniformly charged surface of the photosensitive member 40, forming an electrostatic latent image, corresponding to the yellow image information, on the photosensitive member 40.

Subsequently, a developing bias is applied to the developing roller 53 of the yellow developing device 50Y, causing yellow developer to be attached to the electrostatic latent image so as to form a yellow visible image on the photosensitive member 40. The visible image is transferred to the intermediate transfer belt 61 by the first transfer roller 62.

After the transfer of the yellow image for a page is completed, the exposure unit 30 scans light corresponding to image information of another color, for example, magenta to the photosensitive member 40, forming an electrostatic latent image, corresponding to the magenta image information, on the photosensitive member 40. The magenta developing device 50M supplies magenta developer to the electrostatic latent image to form a visible image. The magenta visible image formed on the photosensitive member 40 is transferred to the intermediate transfer belt 61 by the first transfer roller 62. In this case, the magenta visible image overlaps the previously transferred yellow visible image.

By performing the above-described operation for cyan and black developers, a color image can be formed on the intermediate transfer belt 61 by overlapping the yellow, magenta, cyan and black images. The resulting color image is transferred to the printing medium which is passing through the gap between the intermediate transfer belt 61 and the second transfer roller 63. Then, the printing medium is discharged to the outside of the body 10 by way of the fixing unit 70 and the printing medium discharge unit 80.

In the above-described printing operation, when the image on the photosensitive member 40 is transferred to the intermediate transfer belt 61, a portion of the developer remains on the photosensitive member 40, becoming waste developer. The resulting waste developer remaining on the photosensitive member 40 is removed by the cleaning blade 161. The removed developer is first stored in the first developer storage section 162 of the frame unit 100, and then, is transported into the second developer storage section 163 by the second developer transportation member 167.

A variety of particles, including the developer scattered in the course of being supplied to or removed from the photosensitive member 40, is present around the optical path 90 through which the light emitted from the exposure unit 30 passes. The particles cause deterioration of image quality when the particles enter the optical path 90.

Accordingly, to prevent the particles present around the optical path 90 from entering the optical path 90, the image forming apparatus 1 includes a particle entering prevention device.

Figure 5:
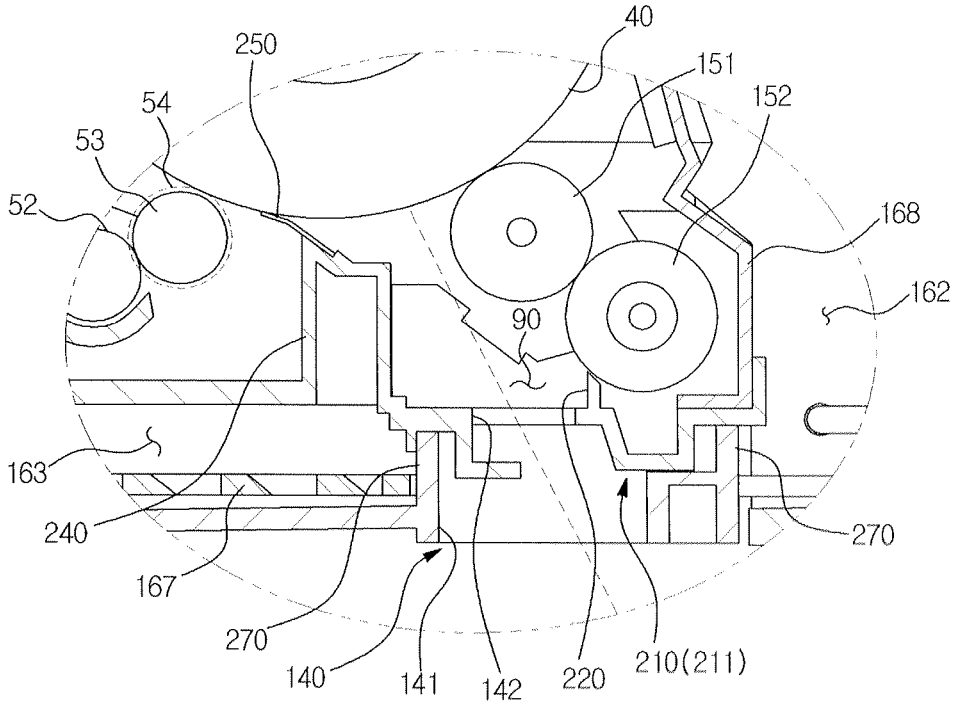
FIG. 5 is a partial enlarged view of FIG. 2.
Figure 6:
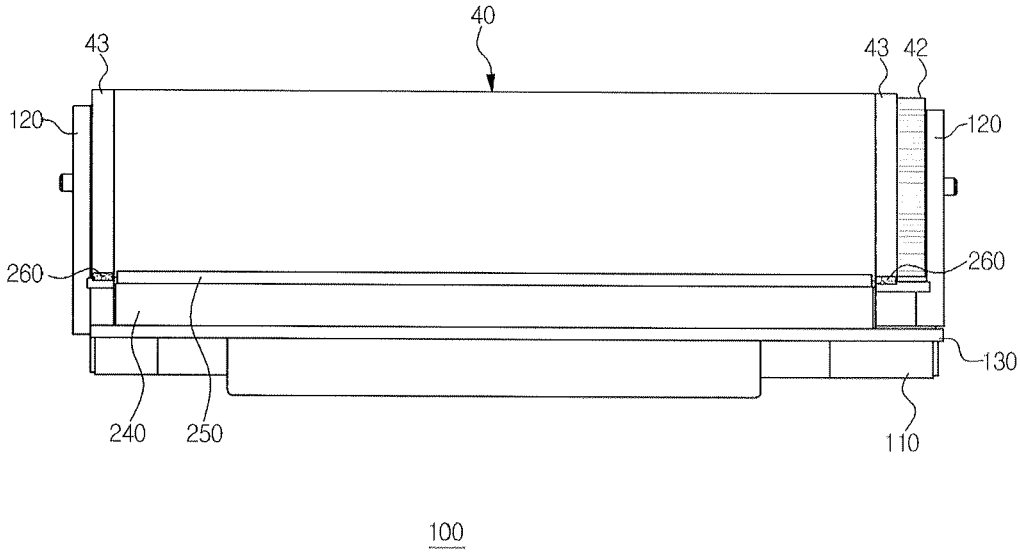
FIG. 6 is a front view illustrating the frame unit of the image forming apparatus in accordance with an embodiment of the present general inventive concept.

FIG. 5 is a partial enlarged view of FIG. 2. FIG. 6 is a front view illustrating the frame unit of the image forming apparatus in accordance with an embodiment of the present general inventive concept.

As illustrated in FIGS. 3 to 5, the particle entering prevention device includes a particle storage unit 210 disposed in a vicinity of the optical path 90, to store particles therein. The particle storage unit 210 receives particles present around the optical path 90 to restrict free movement of the particles, thereby preventing the particles from entering the optical path 90.

The particle storage unit 210, for example, is disposed below a rotator used in image formation, such as the photosensitive member 40, the charging roller 151, or the cleaning roller 152. This is proposed in consideration of the fact that particles such as waste developer, dust, or the like attached to the rotators 40, 151 and 152 fall too much during rotation of the rotators 40, 151 and 152.

The particle storage unit 210 can be disposed in a vicinity of the light window 140 to prevent the particles from entering the light window 140 formed at the frame unit 100. To allow the particle storage unit 210 to effectively prevent the particles from intercepting the light emitted from the light window 140, as illustrated in FIG. 3, a width (W) of the particle storage unit 210, for example, can be larger than a scanning width (d) of the light passing through the light window 140. Although FIG. 3 illustrates an example wherein the width (W) of the particle storage unit 210 is larger than the scanning width (d) of the light passing through the light window 140, but is smaller than a width (D) of the light window 140. In view of maximizing prevention of introduction of particles to the light window 140, for example, the width (W) of the particle storage unit 210 be larger than the width (D) of the light window 140.

The particle storage unit 210 may include a particle storage recess 211 formed at the frame cover 130 at one side of the second light-transmission hole 142. However, the particle storage unit 210 is not limited to the above-described configuration, and can be embodied to any one of other various shapes to store particles around the optical path 90. For example, a separate particle storage tray may be disposed in a vicinity of the optical path 90, or the particle storage recess may be integrally formed at the body 10 rather than the frame unit 100.

As illustrated in FIG. 5, a particle shield wall 220 can be disposed between the particle storage unit 210 and the optical path 90. The particle shield wall 220 serves to prevent the particles stored in the particle storage unit 210 from overflowing toward the optical path 90 by the surrounding air stream. In FIG. 3, the particle shield wall is omitted for convenience of illustration.

As illustrated in FIGS. 3 to 6, the particle entering prevention device further includes side members 230, a protruding wall 240, a film member 250, sealing members 260, and sidewalls 270.

The side members 230 are mounted inside the respective side frames 120. The side members 230 serve not only to rotatably support both ends of the charging roller 151 and the cleaning roller 152, but also to block both lateral sides of the light window 140 so as to prevent the particles from entering the light window 140 in a lateral direction.

The protruding wall 240 protrudes from the frame cover 130 toward the photosensitive member 40. The protruding wall 240 is disposed between the optical path 90 and the developing unit 50, and extends along an axial direction of the photosensitive member 40.

The protruding wall 240 prevents the developer scattered from the developing devices 50Y, 50M, 50C and 50K arranged above the frame cover 130 and particles present at the outside of the frame unit 100 from entering the optical path 90.

The film member 250 can be disposed between the protruding wall 240 and the photosensitive member 40, to exert an elastic force therebetween. In the present embodiment, the film member 250 may be a thin-film member, which is made of urethane, silicone, polyethylene terephthalate (PET), or the like. One end of the film member 250 is fixed to the protruding wall 240, and the other end of the film member 250 elastically comes into contact with the surface of the photosensitive member 40. The film member 250 shields a space between the protruding wall 240 and the photosensitive member 40, thereby preventing the particles from entering the optical path 90.

The sealing members 260 can be mounted to the respective side frames 120 of the frame unit 100, to correspond to the gap-ring contact portions 43 of the photosensitive member 40. The sealing members 260 are interposed between both ends of the photosensitive member 40 and the frame unit 100, to prevent exterior particles from entering the frame unit 100. The sealing member 260 serves not only to seal between the photosensitive member 40 and the frame unit 100, but also to clean particles attached to the gap-ring contact portions 43 of the photosensitive member 40. The sealing members 260 can be made of porous material such as non-woven fabric or polyurethane, or a rubber-based material such as ethylene propylene diene monomer (EPDM), natural rubber (NR), nitrile butadiene rubber (NBR), urethane, silicone, or the like.

The sidewalls 270 protrude upward from a rim of the first light-transmission hole 141. The sidewalls 270 divide the light window 140 from the developer storage sections 162 and 163 within the main frame 110, to prevent the waste developer stored in the frame unit 100 from entering the first light-transmission hole 141.

The first light-transmission hole 141 or the second light-transmission hole 142 of the present embodiment may take a form of a hole providing a predetermined empty space, or may be closed by a transparent member to transmit light.

The light-transmission member 31 of the exposure unit 30 may be eccentrically displaced in a side direction with respect to the first and second light-transmission holes 141 and 142, rather than being disposed on a same vertical line as the light-transmission holes 141 and 142. For example, as illustrated in FIG. 2, the light-transmission member 31 may be eccentrically displaced from the first and second light-transmission holes 142 and 143 to the right side of the drawing. Accordingly, even if particles enter the first light-transmission hole 141 or the second light-transmission hole 142, the particles are not accumulated on the light-transmission member 31 because the light-transmission member 31 is displaced to the right.

Also, although the present embodiment describes an example wherein the light-transmission member 31, made of transparent glass or plastic, is disposed, in a sealing manner, to the case 32 of the exposure unit 30, the light-transmission member 31 can be omitted, and alternatively a light-transmission hole can be formed at the case 32 to enable transmission of light.

As apparent from the above description, various embodiments on the present general inventive concept provides an image forming apparatus, which includes a particle storage unit to restrict free movement of particles around an optical path between a exposure unit and a photosensitive member, thereby preventing particles from entering the optical path.

Further, as a result of providing various structures, functioning to isolate the optical path from an external space, around the optical path, the present general inventive concept has the effect of more efficiently preventing the particles from entering the optical path.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An image forming apparatus, comprising:

an image carrier;

an exposure unit to form a latent image on the image carrier by light;

a particle entering prevention device to prevent particles from entering an optical path between the exposure unit and the image carrier;

a frame unit having a light window disposed on the optical path, wherein the particle storage unit is provided in a vicinity of the light window, and wherein the particle prevention device includes a particle storage unit disposed in a vicinity of the optical path, to store the particles therein.

2. The image forming apparatus according to claim 1, wherein the particle storage unit comprises:

a particle storage recess formed at the frame unit.

3. The image forming apparatus according to claim 1, wherein the particle storage unit has a larger width than a scanning width of light passing through the light window.

4. The image forming apparatus according to claim 1, wherein the particle entering prevention device further comprises:

a particle shield wall disposed between the particle storage unit and the optical path.

5. The image forming apparatus according to claim 1, further comprising:

at least one rotator disposed around the rotating image carrier, wherein the particle storage unit is disposed below the rotator.

6. The image forming apparatus according to claim 5, wherein the particle entering prevention device further comprises:

a side member to rotatably support the rotator and to block a side of the optical path.

7. The image forming apparatus according to claim 1, wherein the particle entering prevention device further comprises:

a protruding wall to protrude toward the image carrier in a vicinity of the optical path.

8. The image forming apparatus according to claim 7, wherein the particle entering prevention device further comprises:

a film member having one side fixed to the protruding wall and an other side in contact with the image carrier.

9. The image forming apparatus according to claim 1, wherein the particle entering prevention device further comprises:

sealing members to seal both ends of the image carrier.

10. The image forming apparatus according to claim 2, wherein the frame unit comprises:

a main frame, and a frame cover to cover the main frame, the light window includes a first light-transmission hole formed at the main frame, and a second light-transmission hole formed at the cover to correspond to the first light-transmission hole, and the particle storage recess is formed in a vicinity of the second light-transmission hole.

11. The image forming apparatus according to claim 10, wherein the frame unit stores waste developer therein, and the particle entering prevention device further includes a sidewall protruding upward from a rim of the first light-transmission hole, to prevent the waste developer from entering the light window.

12. The image forming apparatus according to claim 1, wherein the exposure unit comprises:

a light-transmission member disposed on the optical path, and the light-transmission member and the light window are not vertically aligned.

13. An image forming apparatus, comprising:

an image carrier;

an exposure unit to form a latent image on the image carrier by light; and a particle storage unit disposed in a vicinity of an optical path between the exposure unit and the image carrier, the particle storage unit being configured to store particles therein to prevent particles from entering the optical path, wherein the particle storage unit has a larger width than a scanning width of light passing through the particle storage unit.

14. An image forming apparatus, comprising:

a photosensitive member;

an exposure unit to form a latent image on the photosensitive member by light;

a frame unit having a light window disposed on an optical path between the exposure unit and the photosensitive member; and a particle storage unit to store particles in a vicinity of the light window, so as to prevent the particles from entering the light window.

15. A frame unit for an image forming apparatus, the frame unit comprising:

a light window through which light scanned from an exposure unit of the image forming apparatus passes; and a particle entering prevention device to prevent particles from entering the light window, wherein the particle entering prevention device includes a particle storage unit disposed in a vicinity of the light window, the particle storage unit being configured to store particles therein.

16. The frame unit according to claim 15, further comprising:

a main frame; and a frame cover to cover the main frame, wherein the light window includes a first light-transmission hole formed at the main frame, and a second light-transmission hole formed at the frame cover to correspond to the first light-transmission hole.

17. The frame unit according to claim 16, wherein the particle storage unit comprises:

a particle storage recess formed at one side of the second light-transmission hole.

18. The frame unit according to claim 17, wherein the particle storage recess has a larger width than a scanning width of light passing through the second light-transmission hole.

19. The frame unit according to claim 16, wherein the particle entering prevention device further comprises:

a particle shield wall disposed between the particle storage recess and the second light-transmission hole.

20. The frame unit according to claim 15, further comprising:

a photosensitive member on which an electrostatic latent image is formed by light scanned through the light window.

21. The frame unit according to claim 20, further comprising:

a charging roller to charge the photosensitive member; and a cleaning roller to clean the charging roller, wherein the particle storage unit is disposed below the cleaning roller.

22. A particle entering prevention device usable with an image forming apparatus having a frame unit, a photosensitive member, an exposure unit and an optical path between the exposure unit and the photosensitive member, the particle entering prevention device comprising:

a plurality of side members attached to opposite ends of the frame unit;

a protruding wall disposed between the plurality of side members and to protrude from a frame cover toward the photosensitive member;

a film member in contact with and to shield a space between the protruding wall and the photosensitive member; and a plurality of sealing members interposed between two sides of the photosensitive member, wherein the particle entering prevention device includes a particle storage unit configured to store particles therein, to prevent particles from entering the optical path, and wherein the frame unit includes a light window disposed on the optical path and the particle storage unit is provided in a vicinity of the light window.

* * * * *